US010633880B2

(12) United States Patent
Murata

(10) Patent No.: US 10,633,880 B2
(45) Date of Patent: Apr. 28, 2020

(54) PLANT BUILDING, PLANT, AND COMBINED-CYCLE PLANT

(71) Applicant: Mitsubishi Hitachi Power Systems, Ltd., Kanagawa (JP)

(72) Inventor: Yuichi Murata, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 0 days.

(21) Appl. No.: 16/097,680

(22) PCT Filed: Apr. 26, 2017

(86) PCT No.: PCT/JP2017/016540
§ 371 (c)(1),
(2) Date: Oct. 30, 2018

(87) PCT Pub. No.: WO2017/195602
PCT Pub. Date: Nov. 16, 2017

(65) Prior Publication Data

US 2019/0161989 A1 May 30, 2019

(30) Foreign Application Priority Data

May 9, 2016 (JP) ..... 2016-093624

(51) Int. Cl.
*E04H 5/02* (2006.01)
*B66C 19/00* (2006.01)
(Continued)

(52) U.S. Cl.
CPC ..... *E04H 5/02* (2013.01); *B66C 17/00* (2013.01); *B66C 17/04* (2013.01); *B66C 19/00* (2013.01)

(58) Field of Classification Search
CPC ..... E04H 5/02; B66C 19/00; B66C 19/002; B66C 17/00; B66C 17/04; B66C 17/06
See application file for complete search history.

(56) References Cited

U.S. PATENT DOCUMENTS 9,970,210 B2 * 5/2018 Onishi ..... F01K 13/00
10,087,052 B2 * 10/2018 Koch ..... B66C 17/20
(Continued)

FOREIGN PATENT DOCUMENTS

CN 104640793 5/2015
JP 55-132867 10/1980
(Continued)

OTHER PUBLICATIONS

International Search Report dated Jul. 11, 2017 in International (PCT) Application No. PCT/JP2017/016540 with English translation.
(Continued)

*Primary Examiner* — Andrew J Triggs
(74) *Attorney, Agent, or Firm* — Wenderoth, Lind & Ponack, L.L.P.

(57) ABSTRACT

A plant building (4) includes a building body (5) that has a first installation region (51) where a first rotary machine (2) is installed, a second installation region (52) where a second rotary machine (3) is installed, and a carrying in and out region (53) provided between the first installation region (51) and the second installation region (52) in a horizontal direction, a first overhead crane (6) that is disposed in the building body (5) and is capable of traveling above the first installation region (51) and above the carrying in and out region (53), and a second overhead crane (7) that is disposed at a height position different from a height position of the first overhead crane (6) in the building body (5) and is capable of traveling above the second installation region (52) and above the carrying in and out region (53).

13 Claims, 3 Drawing Sheets

(51) Int. Cl.
*B66C 17/04* (2006.01)
*B66C 17/00* (2006.01)

(56) References Cited

U.S. PATENT DOCUMENTS

| | | | | |
|---|---|---|---|---|
| 2015/0183621 | A1* | 7/2015 | Koch | B66C 17/20<br>212/315 |
| 2017/0138079 | A1* | 5/2017 | Onishi | F01K 13/00 |

FOREIGN PATENT DOCUMENTS

| | | |
|---|---|---|
| JP | 01-299984 | 12/1989 |
| JP | 09-079005 | 3/1997 |
| JP | 09-100642 | 4/1997 |
| JP | 2001-041050 | 2/2001 |
| JP | 2015-209840 | 11/2015 |
| WO | 2015/166761 | 11/2015 |

OTHER PUBLICATIONS

Written Opinion of the International Searching Authority dated Jul. 11, 2017 in International (PCT) Application No. PCT/JP2017/016540 with English translation.

* cited by examiner

PLANT BUILDING, PLANT, AND COMBINED-CYCLE PLANT

TECHNICAL FIELD

The present invention relates to a plant building, a plant, and a combined-cycle plant.

Priority is claimed on Japanese Patent Application No. 2016-093624, filed on May 9, 2016, the content of which is incorporated herein by reference.

BACKGROUND ART

In a power plant, a rotary machine, such as a gas turbine, a steam turbine, and a generator connected to the gas turbine and the steam turbine, is accommodated in a building. For example, a building for a thermal power plant accommodating a plurality of power generation facilities each of which has a steam turbine and a generator coaxially connected to an end portion of the steam turbine is disclosed in PTL 1. The building is configured by a high building part, which covers a steam turbine portion and has a high ceiling, and a low building part, which covers a generator portion and has a low ceiling. A parallel rail type overhead crane is provided in the high building part. Instead of providing an overhead crane, a monorail is provided in the low building part.

CITATION LIST

Patent Literature

[PTL 1] Japanese Unexamined Patent Application, First Publication No. H9-79005

SUMMARY OF INVENTION

Technical Problem

In the power generation facilities disposed in such a plant building, a component part is lifted and lowered by the overhead crane when performing operations such as inspection, repair, assembly, and disassembly. The plant building has a large size such that a space is secured above the power generation facilities in order to make sure that the traveling overhead crane is not interfered with.

In recent years, in order to increase the capacity of a power generation facility with an increase in the size of a plant, the size of each of a plurality of rotary machines such as a gas turbine and a steam turbine has increased. For this reason, a plant building where the plurality of rotary machines are mounted has an even larger size. However, it is desirable to reduce, even if only slightly, the size of the plant building.

The present invention provides a plant building, a plant, and a combined-cycle plant, which capable of reducing size.

Solution to Problem

According to a first aspect of the present invention, there is provided a plant building including a building body that has a first installation region where a first rotary machine is installed, a second installation region where a second rotary machine is installed, and a carrying in and out region provided between the first installation region and the second installation region in a horizontal direction, a first overhead crane that is disposed in the building body and is capable of traveling above the first installation region and above the carrying in and out region, and a second overhead crane that is disposed at a height position different from a height position of the first overhead crane in the building body and is capable of traveling above the second installation region and above the carrying in and out region.

In such a configuration, a component part of the first rotary machine and a component part of the second rotary machine can be carried out from the building body or be carried into the building body with the use of the carrying in and out region. As a result, the size of the building body can be reduced compared to a case where a region for carrying out or carrying in a component part is separately provided in the building body with respect to the first rotary machine and the second rotary machine.

According to a second aspect of the present invention, in the plant building of the first aspect, the first overhead crane may be capable of traveling only above a region excluding the second installation region.

In such a configuration, by making a location where traveling is unnecessary for the first overhead crane impossible to be traveled, a useless space in the plant building can be reduced.

According to a third aspect of the present invention, in the plant building of the first or second aspect, the second overhead crane may be capable of traveling only above a region excluding the first installation region.

In such a configuration, by making a location where traveling is unnecessary for the second overhead crane impossible to be traveled, a useless space in the plant building can be reduced.

According to a fourth aspect of the present invention, in the plant building of any one of the first to third aspects, the first rotary machine may have a first rotary shaft that is rotatable about a first axis, the second rotary machine may have a second rotary shaft that is rotatable about a second axis which is disposed so as to be parallel to the first axis and to be spaced apart from the first axis in the horizontal direction, the first overhead crane may be capable of traveling in the horizontal direction orthogonal to the first rotary shaft, and the second overhead crane may be capable of traveling in the horizontal direction orthogonal to the second rotary shaft.

In such a configuration, a space in the building body can be effectively used. Therefore, the size of the plant building can be further reduced.

According to a fifth aspect of the present invention, in the plant building of the fourth aspect, the first overhead crane may have a pair of first traveling rails extending in the horizontal direction orthogonal to the first rotary shaft, the second overhead crane may have a pair of second traveling rails extending in the horizontal direction orthogonal to the second rotary shaft, and the first traveling rails and the second traveling rails may overlap each other in a vertical direction above the carrying in and out region.

According to a sixth aspect of the present invention, in the plant building of any one of the first to fifth aspects, the second overhead crane may be disposed at a position lower than the first overhead crane, and the building body may have a first ceiling provided above the first overhead crane and a second ceiling provided above the second overhead crane at a position lower than the first ceiling.

In such a configuration, the heights of the building body on a first rotary machine side and a second rotary machine side can be made different from each other. Consequently, it can be prevented that the size of the building body in the vertical direction becomes excessively large by aligning with the size of one rotary machine.

According to a seventh aspect of the present invention, in the plant building of any one of the first to sixth aspects, the first rotary machine may have a first height dimension, which is a dimension from a floor of the building body in a vertical direction necessary for maintenance, the second rotary machine may have a second height dimension, which is a dimension from the floor of the building body in the vertical direction necessary for maintenance, and the second height dimension may be smaller than the first height dimension.

According to an eighth aspect of the present invention, there is provided a plant including the first rotary machine mounted in the first installation region, the second rotary machine mounted in the second installation region, and the plant building according to any one of the first to seventh aspects.

In such a configuration, the overall size of the plant can be reduced in order to make the size of the plant building smaller.

According to a ninth aspect of the present invention, there is provided a multi-shaft combined-cycle plant including the plant building according to any one of the first to seventh aspects, a gas turbine that is the first rotary machine mounted in the first installation region, a steam turbine that is the second rotary machine mounted in the second installation region, and a generator.

According to a tenth aspect of the present invention, there is provided a plant building including a building body that has a first installation region where a first rotary machine having a first rotary shaft rotatable about a first axis is installed and a second installation region where a second rotary machine having a second rotary shaft rotatable about a second axis, which is disposed so as to be parallel to the first axis and to be spaced apart from the first axis in a horizontal direction, is installed, a first overhead crane that is disposed in the building body and is capable of traveling above the first installation region in the horizontal direction orthogonal to the first rotary shaft, a second overhead crane that is disposed at a position lower than the first overhead crane in the building body and is capable of traveling above the second installation region in the horizontal direction orthogonal to the second rotary shaft, a first ceiling provided above the first overhead crane, and a second ceiling provided above the second overhead crane at a position lower than the first ceiling.

In such a configuration, the heights of the building body on a first rotary machine side and a second rotary machine side can be made different from each other. Consequently, it can be prevented that the size of the building body in the vertical direction becomes excessively large by aligning with the size of one rotary machine.

Advantageous Effects of Invention

According to the present invention, the size of the plant building can be reduced.

DESCRIPTION OF EMBODIMENTS

First Embodiment

Hereinafter, a first embodiment according to the present invention will be described with reference to FIGS. 1 to 3.

A plant 1 of the embodiment includes a plurality of (two, in the embodiment) rotary machines. The plant 1 of the embodiment includes a first rotary machine 2, a second rotary machine 3, and a plant building 4.

Figure 1:
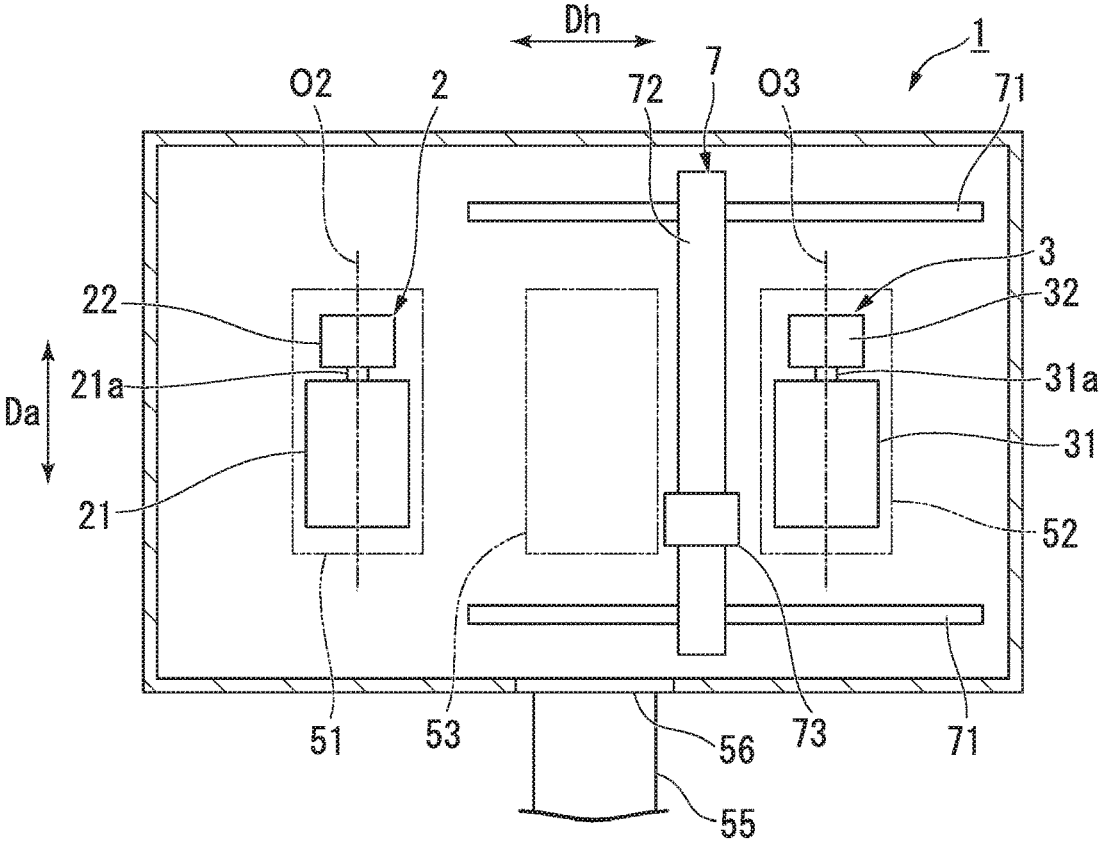
FIG. 1 is a schematic view of a plant building and a first rotary machine according to a first embodiment of the present invention when seen from above.
Figure 2:
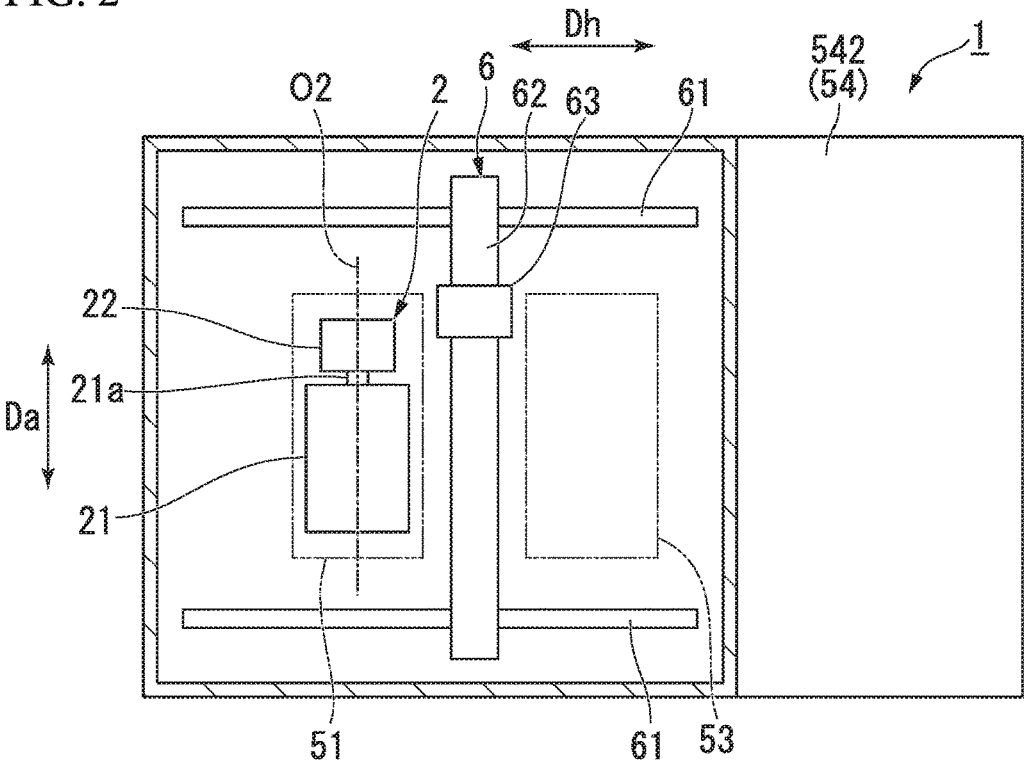
FIG. 2 is a schematic view of the plant building and a second rotary machine according to the first embodiment of the present invention when seen from above.

As illustrated in FIGS. 1 and 2, the first rotary machine 2 has a first rotary shaft 21*a* rotatable about a first axis O2. In the embodiment, the first rotary machine 2 has a gas turbine 21, which has the first rotary shaft 21*a*, and a first generator 22 connected to the first rotary shaft 21*a*. The first rotary shaft 21*a* is connected to each of a rotor of a compressor of the gas turbine 21 and a rotor of a turbine such that the rotor of the compressor of the gas turbine and the rotor of the turbine rotate about the same axis. The first rotary shaft 21*a* is located on the same straight line with a rotor of the first generator 22, and is connected to the rotor of the first generator. The first rotary machine 2 has a first height dimension as a dimension from a floor of a building body 5 in a vertical direction Dv, which is necessary for maintenance and is to be described later.

In the embodiment, a direction where the first axis O2 extends is referred to as an axial direction Da. A horizontal direction orthogonal to the first axis O2 is referred to as an orthogonal direction Dh.

The second rotary machine 3 has a second rotary shaft 31*a* rotatable about a second axis O3. The second rotary machine 3 of the embodiment has sizes in the vertical direction Dv and the orthogonal direction Dh that are smaller than those of the first rotary machine 2. The second axis O3 is disposed so as to be parallel to the first axis and to be spaced apart in the horizontal direction from the first axis O2. That is, the second rotary shaft 31*a* extends in the same direction as the first rotary shaft 21*a*. The second rotary shaft 31*a* is disposed so as to be spaced apart from the first rotary shaft 21*a* in the orthogonal direction Dh. The second rotary machine 3 has a second height dimension as a dimension from the floor of the building body 5 in the vertical direction Dv, which is necessary for maintenance and is to be described later. The second height dimension of the embodiment is smaller than the first height dimension since the second rotary machine 3 is smaller than the first rotary machine 2.

In the embodiment, the second rotary machine 3 has a steam turbine 31, which has the second rotary shaft 31*a*, and a second generator 32 connected to the second rotary shaft 31*a*. The second rotary shaft 31*a* is located on the same straight line with a rotor of the second generator 32, and is connected to the rotor of the second generator.

The plant building 4 accommodates a plurality of (two, in the embodiment) rotary machines. The plant building 4 of the embodiment covers the first rotary machine 2 and the second rotary machine 3. The plant building 4 includes the building body 5, a first overhead crane 6, and a second overhead crane 7.

The building body 5 covers the first rotary machine 2 and the second rotary machine 3. The building body 5 has a first installation region 51, a second installation region 52, and a carrying in and out region 53.

The first installation region 51 is a region where at least a part of the first rotary machine 2 inside the building body 5 is mounted. The first installation region 51 is a space from the floor of the building body 5, which is necessary for maintenance of the first rotary machine 2. The vertical height of the first installation region 51 is larger than the first height dimension of the first rotary machine 2, and is lower than a position where the first overhead crane 6 to be described later is mounted. It is sufficient that the widths of the first installation region 51 in the axial direction Da and the orthogonal direction Dh are larger than the widths of the first rotary machine 2 in the axial direction Da and the orthogonal direction Dh. Therefore, the first installation region 51 of the embodiment is a space larger than a space where the gas turbine 21 is mounted. When seen from above in the vertical direction Dv, the first installation region 51 spreads in the horizontal direction with the first axis O2 as a center of the orthogonal direction Dh.

The second installation region 52 is a region where at least a part of the second rotary machine 3 inside the building body 5 is mounted. The second installation region 52 is a space from the floor of the building body 5, which is necessary for maintenance of the second rotary machine 3. The vertical height of the second installation region 52 is larger than the second height dimension of the second rotary machine 3, and is lower than a position where the second overhead crane 7 to be described later is mounted. It is sufficient that the widths of the second installation region 52 in the axial direction Da and the orthogonal direction Dh are larger than the widths of the second rotary machine 3 in the axial direction Da and the orthogonal direction Dh. Therefore, the second installation region 52 of the embodiment is a space larger than a space where the steam turbine 31 is mounted. When seen from above in the vertical direction Dv, the second installation region 52 spreads in the horizontal direction with the second axis O3 as a center of the orthogonal direction Dh.

The carrying in and out region 53 is a region provided between the first installation region 51 and the second installation region 52 in the horizontal direction. Neither the first rotary machine 2 nor the second rotary machine 3 are mounted in the carrying in and out region 53. The carrying in and out region 53 is a space from the floor of the building body 5, which is necessary for carrying a large-scale component part into or out from the building body 5 at the time of performing operations with respect to the first rotary machine 2 or the second rotary machine 3 such as inspection, repair, assembly, and disassembly. The carrying in and out region 53 is a space interposed between the first installation region 51 and the second installation region 52 in the building body 5. The carrying in and out region 53 is connected to a carrying out path 55 outside the building body 5.

Figure 3:
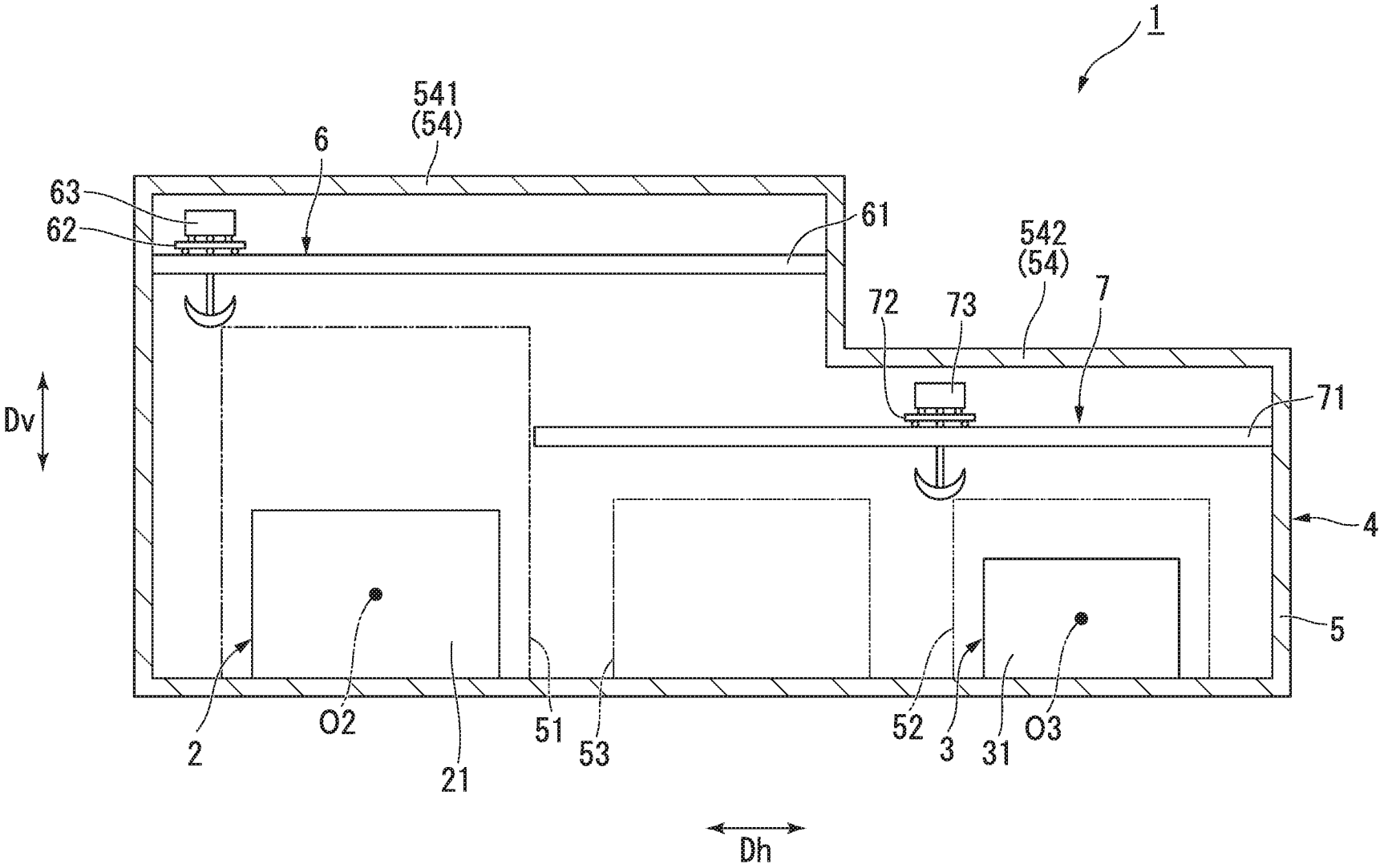
FIG. 3 is a schematic view of the plant building according to the first embodiment of the present invention when seen from a side.

As illustrated in FIG. 3, the building body 5 has a ceiling 54 that covers the upper side of the first rotary machine 2 and the second rotary machine 3. The building body 5 of the embodiment has a first ceiling 541 and a second ceiling 542 as the ceiling 54.

The first ceiling 541 covers the upper side of the first rotary machine 2. The first ceiling 541 covers the upper side of the first installation region 51 and the carrying in and out region 53. The first overhead crane 6 is provided on the first ceiling 541. That is, the first ceiling 541 is provided above the first overhead crane 6.

The second ceiling 542 covers the upper side of the second rotary machine 3. The second ceiling 542 covers only the upper side of the second installation region 52. The second ceiling 542 is disposed at a height position different from that of the first ceiling 541. Specifically, the second ceiling 542 is disposed at a position having a height in the vertical direction Dv lower than that of the first ceiling 541. The second overhead crane 7 is provided on the second ceiling 542. That is, the second ceiling 542 is provided above the second overhead crane 7.

As illustrated in FIGS. 2 and 3, the first overhead crane 6 is disposed in the building body 5. The first overhead crane 6 is capable of traveling above the first installation region 51 and above the carrying in and out region 53 in the horizontal direction.

The first overhead crane 6 is capable of traveling only above a region excluding the second installation region 52 and is capable of traveling only above a region close to the first installation region 51 with respect to the second installation region 52. The first overhead crane 6 of the embodiment is capable of traveling only above the first installation region 51 and above the upper side of the carrying in and out region 53. The first overhead crane 6 is capable of traveling in the orthogonal direction Dh and the axial direction Da. The first overhead crane 6 has a pair of first traveling rails 61, a first girder 62, and a first hoist 63. The pair of first traveling rails 61 is supported by a pillar, a wall, a ceiling, or the like of the building body 5.

The pair of first traveling rails 61 extends in the orthogonal direction Dh in a state of being parallel to each other. The pair of first traveling rails 61 is provided on both sides of the first ceiling 541 in the axial direction Da, respectively. That is, when seen from above in the vertical direction Dv, the first traveling rails 61 extend so as to straddle the first installation region 51 and the carrying in and out region 53, and are disposed at an interval in the axial direction Da.

The first girder 62 is a beam member extending in the axial direction Da so as to straddle the pair of first traveling rails 61. The first girder 62 is capable of traveling a region including the upper side of the gas turbine 21 in the orthogonal direction Dh along the first traveling rails 61. Each of both end portions of the first girder 62 in the axial direction Da is supported by the first traveling rails 61 so as to be capable of traveling.

The first hoist 63 is capable of traveling a region including the upper side of the gas turbine 21 in the axial direction Da along the first girder 62. The first hoist 63 is attached to the first girder 62 so as to be capable of traveling. The first hoist 63 has a lifting sling for lifting or lowering a component part of the first rotary machine 2.

The second overhead crane 7 is disposed at a height position different from that of the first overhead crane 6 in the building body 5. The second overhead crane 7 is capable of traveling above the second installation region 52 and above the carrying in and out region 53 in the horizontal direction.

The second overhead crane 7 is capable of traveling only above a region excluding the first installation region 51 and is capable of traveling only above a region close to the second installation region 52 with respect to the first installation region 51. The second overhead crane 7 of the embodiment is capable of traveling only above the second installation region 52 and above the carrying in and out region 53. The second overhead crane 7 is capable of traveling in the orthogonal direction Dh and the axial direction Da. The second overhead crane 7 is disposed at a position lower than the position of the first overhead crane 6 in the vertical direction Dv. The second overhead crane 7 has a pair of second traveling rails 71, a second girder 72, and a second hoist 73. The pair of second traveling rails 71 is supported by a pillar, a wall, a ceiling, or the like of the building body 5.

The pair of second traveling rails 71 extends in the orthogonal direction Dh in a state of being parallel to each other. The pair of second traveling rails 71 is provided on both sides of the second ceiling 542 in the axial direction Da, respectively. That is, when seen from above in the vertical direction Dv, the second traveling rails 71 extend so as to straddle the second installation region 52 and the carrying in and out region 53, and are disposed at an interval in the axial direction Da. The second traveling rails 71 are disposed so as to be spaced apart from the first ceiling 541 and the second ceiling 542 above the carrying in and out region 53. Consequently, the first traveling rails 61 and the second traveling rails 71 overlap each other in the vertical direction Dv above the carrying in and out region 53.

The second girder 72 is a beam member extending in the axial direction Da so as to straddle the pair of second traveling rails 71. The second girder 72 is capable of traveling a region including the upper side of the steam turbine 31 in the orthogonal direction Dh along the second traveling rails 71. Each of both end portions of the second girder 72 in the axial direction Da is supported by the second traveling rails 71 so as to be capable of traveling.

The second hoist 73 is capable of traveling a region including the upper side of the steam turbine 31 in the axial direction Da along the second girder 72. The second hoist 73 is attached to the second girder 72 so as to be capable of traveling. The second hoist 73 has a lifting sling for lifting or lowering a component part of the second rotary machine 3.

When performing operations with respect to the first rotary machine 2 or the second rotary machine 3, such as inspection, repair, assembly, and disassembly, the first rotary machine 2 or the second rotary machine 3, which is a target, is stopped in the plant 1 of the embodiment.

When performing an operation with respect to the first rotary machine 2, the first overhead crane 6, which is capable of traveling only above the first installation region 51 and above the carrying in and out region 53 in the orthogonal direction Dh and the axial direction Da, is used. Specifically, an operation of lifting and lowering a component part of the first rotary machine 2 is performed by the first overhead crane 6, and the component part is conveyed to the carrying in and out region 53. As a result, the component part of the first rotary machine 2 can be carried out from the carrying out path 55 to the outside of the building body 5, or can be carried in from the outside via the carrying in and out region 53.

When performing an operation with respect to the second rotary machine 3, the second overhead crane 7, which is capable of traveling only above the second installation region 52 and above the carrying in and out region 53 in the orthogonal direction Dh and the axial direction Da, is used. Specifically, an operation of lifting and lowering a component part of the second rotary machine 3 is performed by the second overhead crane 7, and the component part is conveyed to the carrying in and out region 53. As a result, the component part of the second rotary machine 3 can be carried out from the carrying out path 55 to the outside of the building body 5, or can be carried in from the outside via the carrying in and out region 53.

That is, a component part of the first rotary machine 2 and a component part of the second rotary machine 3 can be carried out from the building body 5 or be carried into the building body 5 by using the carrying in and out region 53. As a result, the size of the building body 5 in the orthogonal direction Dh can be reduced compared to a case where a region for carrying out or carrying in a component part is separately provided in the building body 5 with respect to the first rotary machine 2 and the second rotary machine 3.

In addition, the second ceiling 542 can be provided at a position lower than that of the first ceiling 541 by disposing the second overhead crane 7 at a position lower than that of the first overhead crane 6. That is, the heights of the ceiling 54 of the building body 5 on a first rotary machine 2 side and a second rotary machine 3 side can be made different from each other. Therefore, the position of the ceiling 54 in the vertical direction Dv can be aligned with each of the first rotary machine 2 and the second rotary machine 3. Consequently, it can be prevented that the size of the building body 5 in the vertical direction Dv becomes excessively large by aligning with the size of one rotary machine.

Therefore, the sizes of the building body 5 in the orthogonal direction Dh and the vertical direction Dv can be reduced, and thus the size of the plant building 4 can be reduced.

In addition, the first overhead crane 6 is not capable of traveling above the second installation region 52 since the first overhead crane is made to be capable of traveling only above the first installation region 51 and above the carrying in and out region 53. For this reason, regardless of the size of the second rotary machine 3 in the vertical direction Dv, the position of the first ceiling 541 in the vertical direction Dv can be determined so as to be aligned with the size of the first rotary machine 2 in the vertical direction Dv. Therefore, by making a location where traveling is unnecessary for the first overhead crane 6 impossible to be traveled, a useless space in the plant building 4 can be reduced.

Similarly, the second overhead crane 7 is not capable of traveling above the first installation region 51 since the second overhead crane is made to be capable of traveling only above the second installation region 52 and above the carrying in and out region 53. For this reason, regardless of the size of the first rotary machine 2 in the vertical direction Dv, the position of the second ceiling 542 in the vertical direction Dv can be determined so as to be aligned with the size of the second rotary machine 3 in the vertical direction Dv. Therefore, by making a location where traveling is unnecessary for the second overhead crane 7 impossible to be traveled, a useless space in the plant building 4 can be reduced.

Therefore, the first ceiling 541 and the second ceiling 542 can be provided so as to be independent of each other by being aligned with the first rotary machine 2 and the second rotary machine 3 respectively. That is, the positions of the building body 5 in the vertical direction Dv in the first installation region 51 and the second installation region 52 can be set independently of each other corresponding to the first rotary machine 2 and the second rotary machine 3 respectively. Consequently, the size of the plant building 4 can be further reduced.

The second installation region 52 is provided so as to be spaced apart from the first installation region 51 in the orthogonal direction Dh such that the first axis O2 and the second axis O3 are disposed to be parallel to each other and to be spaced apart from each other in the horizontal direction. In addition, the first traveling rails 61 and the second traveling rails 71 are allowed to overlap each other above the carrying in and out region 53 in the vertical direction Dv. That is, the first traveling rails 61 and the second traveling rails 71 can be disposed so as to be spaced apart from each other above the carrying in and out region 53 in the vertical direction Dv. In other words, when seen from above in the vertical direction Dv, the first traveling rails 61 and the second traveling rails 71 are disposed so as to overlap each other in a direction where the first traveling rails 61 extend. Consequently, a space in the building body 5 can be effectively used. Therefore, the size of the plant building 4 can be further reduced even when the first overhead crane 6 is provided such that only the first rotary machine 2 becomes a target and the second overhead crane 7 is provided such that only the second rotary machine 3 becomes a target.

In addition, the first rotary machine 2 and the second rotary machine 3 can be disposed so as to be spaced apart from each other in the orthogonal direction Dh with the carrying in and out region 53 interposed therebetween. For this reason, a space between the first rotary machine 2 and the second rotary machine 3 can be effectively used as the carrying in and out region 53.

In addition, the overall size of the plant 1 can be reduced by mounting the first rotary machine 2 and the second rotary machine 3 in the plant building 4.

Second Embodiment

Next, a plant of a second embodiment will be described with reference to FIG. 4.

In the second embodiment, the same constituent elements as those of the first embodiment will be assigned with the same reference signs and detailed description thereof will be omitted. The plant of the second embodiment is different from that of the first embodiment in that a first overhead crane and a second overhead crane do not overlap each other.

A plant 1A of the second embodiment is different from that of the first embodiment in terms of a configuration of a plant building 4A.

Figure 4:
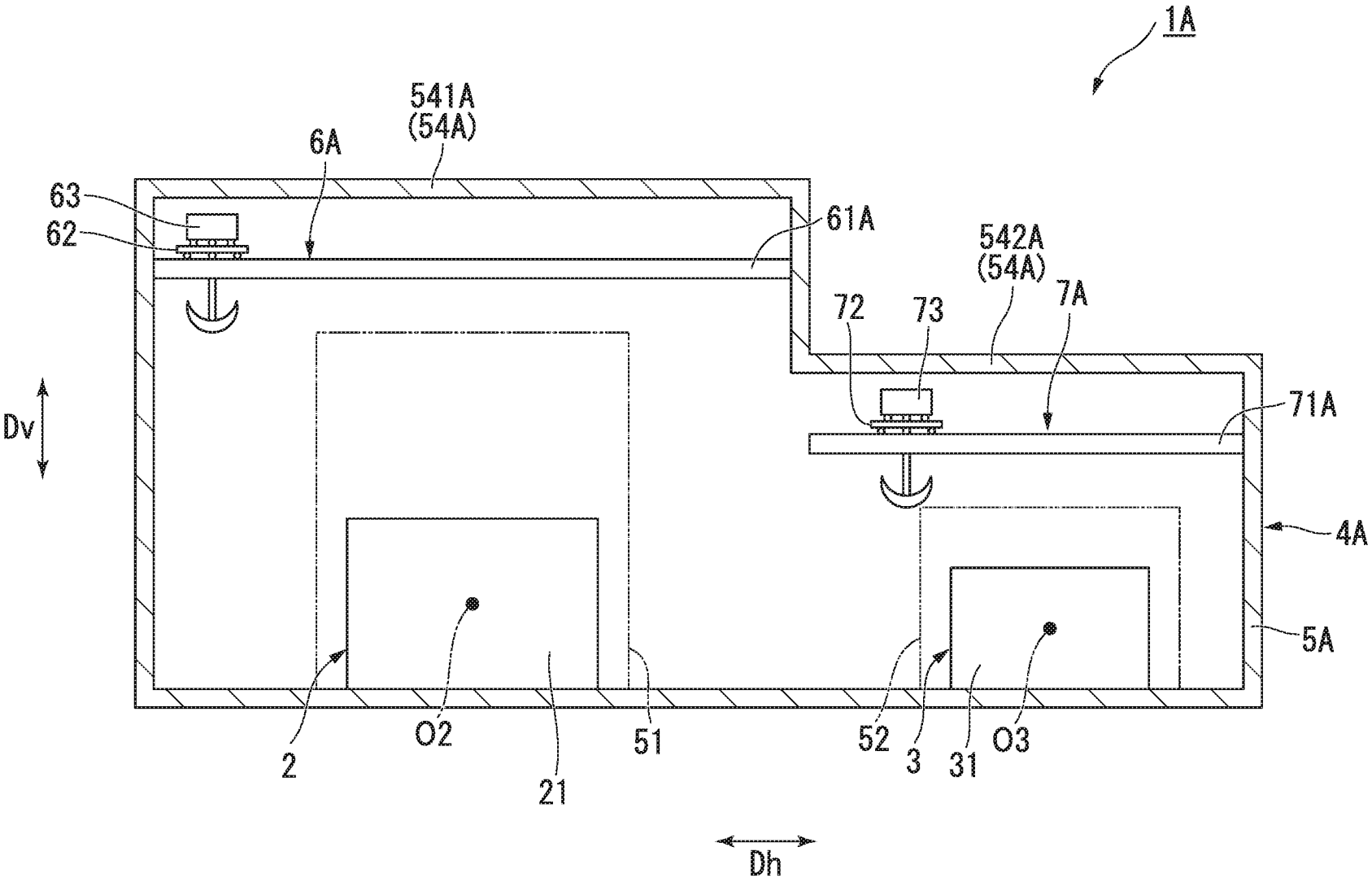
FIG. 4 is a schematic view of a plant building according to a second embodiment of the present invention when seen from a side.

As illustrated in FIG. 4, the plant building 4A accommodates two rotary machines as in the first embodiment. The plant building 4A of the embodiment includes a building body 5A, a first overhead crane 6A, and a second overhead crane 7A.

The building body 5A covers the first rotary machine 2 and the second rotary machine 3. The building body 5A has the first installation region 51 and the second installation region 52. The building body 5A has a ceiling 54A that covers the upper side of the first rotary machine 2 and the second rotary machine 3. The building body 5A of the embodiment has a first ceiling 541A and a second ceiling 542A as the ceiling 54A.

The building body 5A of the second embodiment is not limited to having the carrying in and out region in between the first installation region 51 and the second installation region 52. For example, a space of the first installation region 51 on a side where the second rotary machine 3 is not mounted may be a space for carrying a large-scale component part into or out from the building body 5 at the time of performing operations such as inspection, repair, assembly, and disassembly. Similarly, a space of the second installation region 52 on a side where the first rotary machine 2 is not mounted may be a space for carrying a large-scale component part into or out from the building body 5 at the time of performing operations such as inspection, repair, assembly, and disassembly.

The first ceiling 541A covers the upper side of the first rotary machine 2. The first ceiling 541A covers the upper side of a space between the first rotary machine 2 and the second rotary machine 3 from above the first installation region 51. The first overhead crane 6A is provided on the first ceiling 541A. That is, the first ceiling 541A is provided above the first overhead crane 6A.

The second ceiling 542A covers the upper side of the second rotary machine 3. The second ceiling 542A covers the upper side of a space between the first rotary machine 2 and the second rotary machine 3 from above the second installation region 52. The second ceiling 542A is disposed at a position having a height in the vertical direction Dv lower than that of the first ceiling 541A. The second overhead crane 7A is provided on the second ceiling 542A. That is, the second ceiling 542A is provided above the second overhead crane 7A.

The first overhead crane 6A is disposed in the building body 5A. The first overhead crane 6A is capable of traveling above the first installation region 51 in the horizontal direction. The first overhead crane 6A has a pair of first traveling rails 61A, the first girder 62, and the first hoist 63.

The pair of first traveling rails 61A extends in the orthogonal direction Dh in a state of being parallel to each other. The pair of first traveling rails 61A is provided on both sides of the first ceiling 541A in the axial direction Da, respectively. That is, when seen from above in the vertical direction Dv, the first traveling rails 61A extend so as to cross the first installation region 51, and are disposed at an interval in the axial direction Da. The first overhead crane 6A is disposed only below the first ceiling 541A.

The second overhead crane 7A is provided at a position lower than that of the first overhead crane 6A in the building body 5. The second overhead crane 7A is capable of traveling above the second installation region 52 in the horizontal direction. The second overhead crane 7A is disposed at a position lower than the position of the first overhead crane 6A in the vertical direction Dv. The second overhead crane 7A has a pair of second traveling rails 71A, the second girder 72, and the second hoist 73.

The pair of second traveling rails 71A extends in the orthogonal direction Dh in a state of being parallel to each other. The pair of second traveling rails 71A is disposed on both sides of the second ceiling 542A in the axial direction Da, respectively. That is, when seen from above in the vertical direction Dv, the second traveling rails 71 extend so as to cross the second installation region 52, and are disposed at an interval in the axial direction Da. The second overhead crane 7A is disposed only below the second ceiling 542A. That is, the second traveling rails 71A are provided so as not to overlap the first traveling rails 61A in the vertical direction Dv. Therefore, when seen from above in the vertical direction Dv, the second traveling rails 71 are provided such that positions in the horizontal direction thereof do not overlap the positions of the first traveling rails 61A in the horizontal direction.

In the plant building 4A of the second embodiment, the second ceiling 542A can be provided at a lower position than that of the first ceiling 541A in accordance with the fact that the second overhead crane 7A is disposed at a position lower than that of the first overhead crane 6A. That is, the heights of the ceiling 54A of the building body 5A on the first rotary machine 2 side and the second rotary machine 3 side can be made different from each other. Therefore, the position of the ceiling 54A in the vertical direction Dv can be aligned with each of the first rotary machine 2 and the second rotary machine 3. Consequently, it can be prevented that the size of the building body 5A in the vertical direction Dv becomes excessively large by aligning with the size of one rotary machine.

Hereinbefore, the embodiments of the present invention are described in detail with reference to the drawings. However, the respective configurations and combinations thereof in the respective embodiments are merely examples, and additions, omissions, substations, and other modifications of configurations are possible within the scope which does not depart from the gist of the present invention. In addition, the present invention is not limited to the embodiments and are limited by only claims.

Without being limited to having the gas turbine 21, it is sufficient that the first rotary machine 2 is a rotary machine having the first rotary shaft 21*a*. Similarly, without being limited to having the steam turbine 31, it is sufficient that the second rotary machine 3 is a rotary machine having the second rotary shaft 31*a*. Therefore, contrary to the embodiment, the first rotary machine 2 may have the steam turbine 31, and the second rotary machine 3 may have the gas turbine 21. In addition, the first rotary machine 2 or the second rotary machine 3 may have a pump.

In addition, as in the first embodiment, the plant building 4 is not limited to having the first ceiling 541 which has a position in the vertical direction Dv that is higher than that of the second ceiling 542. It is sufficient that the first ceiling and the second ceiling are disposed at height positions different from each other. For example, the plant building 4 may have a structure where the first overhead crane 6 is disposed at a position in the vertical direction Dv lower than that of the second overhead crane 7 and the first ceiling 541 is at a position in the vertical direction Dv lower than that of the second ceiling 542.

In each of the embodiments, a multi-shaft combined-cycle plant including a gas turbine, which is a first rotary machine mounted in a first installation region, a steam turbine, which is a second rotary machine mounted in a second installation region, a first generator connected to the gas turbine, a second generator connected to the steam turbine, a heat recovery steam generator connected to the gas turbine, and a condenser connected to the steam turbine may be adopted.

In addition, the first rotary machine may be the steam turbine, and the second rotary machine may be the gas turbine. In this case, a multi-shaft combined-cycle plant including a steam turbine, which is a first rotary machine mounted in a first installation region, a gas turbine, which is a second rotary machine mounted in a second installation region, a first generator connected to the steam turbine, a second generator connected to the gas turbine, a heat recovery steam generator connected to the gas turbine, and a condenser connected to the steam turbine may be adopted.

INDUSTRIAL APPLICABILITY

In the plant building, the plant, and the combined-cycle plant, the size of plant building can be reduced.

REFERENCE SIGNS LIST

1: plant
2: first rotary machine
21: gas turbine
O2: first axis
21*a*: first rotary shaft
22: first generator
3: second rotary machine
31: steam turbine
O3: second axis
31*a*: second rotary shaft
32: second generator
4, 4A: plant building
5, 5A: building body
51: first installation region
52: second installation region
53: carrying in and out region
54, 54A: ceiling
541, 541A: first ceiling
542, 542A: second ceiling
56: entrance for carrying out
6, 6A: first overhead crane
61, 61A: first traveling rail
62: first girder
63: first hoist
7, 7A: second overhead crane
71, 71A: second traveling rail
72: second girder
73: second hoist
Dv: vertical direction
Da: axial direction
Dh: orthogonal direction

The invention claimed is:

1. A plant building comprising:

a building body that has a first installation region where a first rotary machine is installed, a second installation region where a second rotary machine is installed, and a carrying in and out region provided between the first installation region and the second installation region in a horizontal direction;

a first overhead crane that is disposed in the building body and is capable of traveling above the first installation region and above the carrying in and out region; and a second overhead crane that is disposed at a height position different from a height position of the first overhead crane in the building body and is capable of traveling above the second installation region and above the carrying in and out region, wherein the first overhead crane is capable of traveling only above a region excluding the second installation region.

2. The plant building according to claim 1, wherein the second overhead crane is capable of traveling only above a region excluding the first installation region.

3. The plant building according to claim 1, wherein the first rotary machine has a first rotary shaft that is rotatable about a first axis, the second rotary machine has a second rotary shaft that is rotatable about a second axis which is disposed so as to be parallel to the first axis and to be spaced apart from the first axis in the horizontal direction, the first overhead crane is capable of traveling in the horizontal direction orthogonal to the first rotary shaft, and the second overhead crane is capable of traveling in the horizontal direction orthogonal to the second rotary shaft.

4. The plant building according to claim 3, wherein the first overhead crane has a pair of first traveling rails extending in the horizontal direction orthogonal to the first rotary shaft, the second overhead crane has a pair of second traveling rails extending in the horizontal direction orthogonal to the second rotary shaft, and the first traveling rails and the second traveling rails overlap each other in a vertical direction above the carrying in and out region.

5. The plant building according to claim 1, wherein the second overhead crane is disposed at a position lower than the first overhead crane, and the building body has a first ceiling provided above the first overhead crane, and a second ceiling provided above the second overhead crane at a position lower than the first ceiling.

6. The plant building according to claim 1, wherein the first rotary machine has a first height dimension, which is a dimension from a floor of the building body in a vertical direction necessary for maintenance, the second rotary machine has a second height dimension, which is a dimension from the floor of the building body in the vertical direction necessary for maintenance, and the second height dimension is smaller than the first height dimension.

7. A plant comprising:

the first rotary machine installed in the first installation region;

the second rotary machine installed in the second installation region; and the plant building according to claim 1.

8. A multi-shaft combined-cycle plant comprising:

the plant building according to claim 1;

a gas turbine that is the first rotary machine installed in the first installation region;

a steam turbine that is the second rotary machine installed in the second installation region; and a generator.

9. A plant building comprising:

a building body that has a first installation region where a first rotary machine having a first rotary shaft rotatable about a first axis is installed and a second installation region where a second rotary machine having a second rotary shaft rotatable about a second axis, which is disposed so as to be parallel to the first axis and to be spaced apart from the first axis in a horizontal direction, is installed;

a first overhead crane that is disposed in the building body and is capable of traveling above the first installation region in the horizontal direction orthogonal to the first rotary shaft;

a second overhead crane that is disposed at a position lower than the first overhead crane in the building body and is capable of traveling above the second installation region in the horizontal direction orthogonal to the second rotary shaft;

a first ceiling provided above the first overhead crane; and a second ceiling provided above the second overhead crane at a position lower than the first ceiling, wherein the first overhead crane is capable of traveling only above a region excluding the second installation region, the first overhead crane has a pair of first traveling rails which extends in the horizontal direction orthogonal to the first rotary shaft in a state of being parallel to each other, and the second overhead crane has a pair of second traveling rails which extends in the horizontal direction orthogonal to the second rotary shaft in a state of being parallel to each other.

10. The plant building according to claim 9, wherein the first traveling rails and the second traveling rails are disposed so as to overlap each other in a direction where the first traveling rails extend, when seen from above in the vertical direction.

11. The plant building according to claim 9, wherein the building body has a carrying in and out region inside thereof.

12. The plant building according to claim 11, wherein the carrying in and out region is region provided between the first installation region and the second installation region in a horizontal direction.

13. The plant building according to claim 9, wherein the second overhead crane is capable of traveling only above a region excluding the first installation region.

* * * * *